US007531127B2

(12) United States Patent
Mizuno

(10) Patent No.: US 7,531,127 B2
(45) Date of Patent: May 12, 2009

(54) CONTAINER

(75) Inventor: Hitoshi Mizuno, Toyota (JP)

(73) Assignee: Hoei Shokai Co., Ltd., Aichi (JP)

( * ) Notice: Subject to any disclaimer, the term of this patent is extended or adjusted under 35 U.S.C. 154(b) by 476 days.

(21) Appl. No.: 10/572,802

(22) PCT Filed: Nov. 9, 2005

(86) PCT No.: PCT/JP2005/020523

§ 371 (c)(1),
(2), (4) Date: Mar. 22, 2006

(87) PCT Pub. No.: WO2006/092889

PCT Pub. Date: Sep. 8, 2006

(65) Prior Publication Data

US 2008/0246196 A1 Oct. 9, 2008

(30) Foreign Application Priority Data

Feb. 28, 2005 (JP) ..... 2005-052898

(51) Int. Cl.
*B22D 41/00* (2006.01)

(52) U.S. Cl. ..... 266/239; 266/275

(58) Field of Classification Search ..... 266/242, 266/200, 275, 239
See application file for complete search history.

(56) References Cited

U.S. PATENT DOCUMENTS

D528,573 S * 9/2006 Aoki et al. ..... D15/144.1
7,204,954 B2 * 4/2007 Mizuno et al. ..... 266/239
7,396,504 B2 * 7/2008 Kodama et al. ..... 266/239

FOREIGN PATENT DOCUMENTS

| | | | |
|---|---|---|---|
| DE | 2427751 | A1 | 1/1975 |
| JP | 51-134333 | A | 11/1976 |
| JP | 05-293634 | A | 11/1993 |
| JP | 2001-059685 | A | 3/2001 |
| JP | 2002-254158 | A | 9/2002 |
| JP | 2002-254158 | A | 9/2002 |
| JP | 2004-276118 | A | 10/2004 |

OTHER PUBLICATIONS

Written Opinion from International Search Authority (PCT/ISA/237), no date.
Chinese Office Action (4 pages) with English translation (6 pages), Application No. 200580001142.9, Jul. 6, 2007.

* cited by examiner

*Primary Examiner*—Scott Kastler
(74) *Attorney, Agent, or Firm*—Rader, Fishman & Grauer, PLLC

(57) ABSTRACT

A molten metal container that, even when an openable lid is made larger, can be easily opened and closed at a high safety level. The container includes a container main body that has a first opening in an upper portion and can store a molten metal, a first lid that can cover the first opening and is rotatably disposed in a horizontal direction against the first opening, a pressurized gas introduction port for introducing a pressurized gas into the container main body and a flow path that supplies the molten metal stored inside of the container main body outside thereof.

4 Claims, 6 Drawing Sheets

CONTAINER

FIELD OF THE INVENTION

This invention relates, for example, to a container suitable for transporting molten aluminum.

BACKGROUND OF THE INVENTION

An aluminum alloy that is used, for example, in an automobile engine is supplied in a molten state to a server of a die-cast machine. A container that has been called "a ladle" is used in a transportation of such molten aluminum.

In this system, aluminum is melted to blend in a factory where an aluminum alloy is blended and poured in a container in a molten state. The container is placed on a truck and transported to a factory where an engine is molded, and the container is placed on a forklift to transport to a server of a die-cast machine, and the molten aluminum is supplied from the container to the server.

When aluminum alloy is once solidified in a factory where it is blended and transported to a factory having a die-cast machine in, so-called, an ingot state, a process of melting the ingot in the factory having the die-cast machine becomes necessary. Accordingly, there are problems in that energy is wasted and $CO_2$ exhaust increases. The above-mentioned system intends to overcome such problem.

The inventors of the present invention proposed a hermetically sealed container supplying molten aluminum using pressure difference and have variously applied improvements thereto. A basic embodiment of such container is that a cylindrical container main body with an upper portion being opened and covered with a large lid, a hatch disposed at a substantially center of the large lid is provided with a port for introducing a gas for applying pressure inside the container and also with a flowpath and a pipe for supplying molten aluminum to the container main body.

The large lid is solidly attached with a bolt and a nut through a packing to the container main body, one end side of a two-dimensionally seen hatch (small lid) is attached with a hinge to the large lid, and the other side thereof is made fixable to the large lid with a bolt with a handle. The hatch, after taking the bolt with a handle off the main body, can be opened and closed up and down with the hinge as an axis (See JP-A-2004-276118).

The reason why the hatch is provided is to open the hatch to pre-heat the inside of the container with a gas burner. Another reason why the hatch is provided is to externally scoop oxide (called as slag) floating on the surface of the molten aluminum stored in the container. Specifically, the hatch is opened and a tool for scooping the slag is inserted to the inside of the container to scoop the slag from the surface of the molten aluminum and the slag is taken to the outside of the container.

DISCLOSURE OF THE INVENTION

Problems to be Solved

Demand for higher accuracy in blending the aluminum alloy became stronger. In that case, the oxide needs to be scooped cautiously and carefully. However, since a diameter of an existing hatch is about as half as that of the large lid, it is troublesome to peep the surface of the molten aluminum from the outside through the opening of the hatch and scoop as well. Accordingly, the diameter of the hatch is desired to be larger than ever, however, the hatch becomes heavy as its size thereof increases and the opening and closing of the hatch can become much more troublesome. In particular, since the container needs to be opened and closed under a high temperature environment, there are problems from safety point of view as well.

The present invention was achieved to overcome such problems and intends to provide a container that can be easily opened and closed even when the openable lid is made larger and with higher safety level.

Means for Solving the Problem

In order to overcome such problems, a container according to a first aspect of the invention includes a container main body that has a first opening in an upper portion thereof and can store a molten metal, a first lid that can cover the first opening and is disposed rotatable in a horizontal direction against the first opening, a pressurized gas introducing port for introducing a pressured gas into the container main body and a flow path that externally supplies the molten metal stored inside of the container main body.

In the present invention, since the first lid is disposed rotatable in a horizontal direction against the first opening of the container main body, a force necessary to open and close the lid is smaller compared to the force when opening and closing the lid in up and down movement. Thereby, even when an openable lid is made larger, a container with easier opening and closing operation and with higher safety level can be provided.

It is preferable that the container main body includes a storing portion having a second opening larger than the first opening in an upper portion thereof and a second lid that is solidly disposed to the storing portion so as to cover the second opening and the first opening.

It is preferable that the second lid has a supporting portion that rotatably and pivotally supports the first lid.

It is preferable that the first lid is supported by the supporting portion so as to be lifted up from a surface of the second lid, and, at an external periphery portion of the first lid, a first supporting and guiding member that has a first roller that rotatably contacts with an area other than the first opening on a surface of the second lid and capable of moving up and down is disposed.

Thereby, a force necessary to open and close the lid becomes smaller.

It is preferable that the container has a second supporting and guiding member that has a second roller disposed near the supporting portion of the first lid and a guiding rail that is attached to the container main body and supports and guides the second roller when the first roller is at a position away from the second surface.

Thereby, even when the first roller is at a position away from the second surface, a force necessary to open and close the lid becomes smaller.

A container according to a second aspect of the invention includes a container main body that has, in an upper portion thereof, a first area provided with a first opening and a second area provided with a pipe fixing portion and a lid rotation support portion and is capable of storing a molten metal, a first lid that can cover the first opening and is rotatably attached to the lid rotation support portion in a horizontal direction against the first opening, a flow path a flow path that supplies the molten metal stored inside the container main body to an outside, a pipe that is fixed to the pipe fixing portion and communicates with the flow path, and a pressurized gas introducing means that introduces a gas for applying pressure into the container main body.

In the invention, since the first lid is rotatably disposed in a horizontal direction against the first opening of the container main body, a force necessary for opening and closing the lid becomes smaller in comparison with a case where the lid is opened and closed up and down. In addition, since the pipe fixing portion and the lid rotation support portion are gathered in the second area, the first area can be made larger and thereby the first opening can be made larger. Thereby, an operation of scooping the oxide can be more preferably carried out.

It is preferable that the first lid has a lid main body capable of covering the first opening and a connecting member that is fixed rotatably against the lid rotation support portion and supports the lid main body.

Thereby, the first lid can be inhibited from interfering with the pipe fixing portion and the lid rotation support portion. Furthermore, the first lid can be formed with lighter weight and a rotating radius being made larger in the same time.

EFFECTS OF THE INVENTION

According to the present invention, since the first lid is rotatably disposed in a horizontal direction against the first opening of the container main body, a container that can be easily opened and closed even when an openable lid is made larger and with higher safety can be provided.

BEST MODE FOR CARRYING OUT THE INVENTION

Hereinafter, embodiments of the present invention will be described in detail with reference to the drawings.

FIG. 1 is a plan view (with a first lid opened) of a container involving a first embodiment of the invention, FIG. 2 being a plan view when the lid in FIG. 1 is closed, and FIG. 3 being a sectional view of FIG. 2.

A container 100 includes a container main body 200, a small lid 300 as a first lid and a pipe 400.

(Detail Description of Container Main Body 200)

The container main body 200 includes a storing portion 210 having an opening portion 211 entire upper surface of which opens and a large lid 230 disposed to the storing portion 210 to cover all of the opening portion 211; the large lid 230 has an opening portion 231 which is smaller than the opening potion 211.

Storing Portion 210

The storing portion 210 has a frame main body 212 having a bottom and an opening on an upper portion thereof, a heat-insulating layer 213 disposed inside the frame main body 212, and a refractory layer 214 that covers the heat-insulating layer 213. A storing space 215 is disposed inside the refractory layer 214. The refractory layer 214 is denser than the heat-insulating layer 213 and high in the thermal conductivity. It goes without saying that the heat-insulating layer 213 and the refractory layer 214, as needs arise, may be formed in a plurality of layers.

A flange 215 is provided at an outer peripheral of the opening portion of the frame main body 212. A pair of a channel member 217 is attached to the outer side of the bottom portion 216 of the frame main body 212. A fork of the forklift that conveys the container 100 can be inserted into and removed from the channel members 217.

A protruding portion 218 protrudes along an inner wall of the refractory layer 214 in the side of storing space 215 (i.e. inside). The protruding portion 218 is integrated with the refractory layer 214 in a vertical direction. In other words, the protrusion portion 218 is formed of the refractory layer 214 itself. A flow path 219 for having a molten metal flow between inside and outside container is provided inside the protruding portion 218 along with the vertical direction. The flow path 219 is formed from a position close to the bottom of the storing portion 215 to the upper portion of the storing space 215.

A pipe 219 is surrounded by, for example, a pipe 220 made of ceramics. As a result, when the inside of the storing portion 215 is applied with pressure, gas can be prevented from entering the flow path 219. However, the container 100 according to the invention can do without the pipe 220 like this.

Large Lid 230

A large lid 230 is provided with a cap-like metal frame main body 232, a heat-insulating layer 233 laid inside of the frame main body 232 and a refractory layer 234 that buries a remaining excess space.

Along an external periphery of the large lid 230, a flange 235 is disposed. The flange 235 is placed on the flange 215 disposed along an external periphery of the storing portion 210, and the flange 215 and the flange 235 are fixed with bolts and nuts (omitted from showing in the drawing) at a plurality of places. Thereby, the large lid 230 is solidly fixed to the storing portion 210. In order to improve the air tightness inside the container 100, a packing material (omitted from showing in the drawing) is inserted between the flanges 215 and 235.

The large lid 230, when seen two-dimensionally, has a first area 236 provided with an opening portion 231 and a second area 239 provided with a pipe fixing portion 237 and a lid rotation support portion 238.

The first area 236, with a center of the large lid 230 as a center of rotation, is located within a range of a radius of rotation of substantially from 0 degree to 225 degrees, and a range of a remaining radius of rotation (from 225 degrees to 360 degrees) is taken as the second area 239. Further, ratio of the areas is an example and of course may be different.

The opening portion 231 occupies substantially a half the first area 236 and along an external periphery of the opening portion 231 a flange 240 is disposed.

In the second area 239, the pipe fixing portion 237 and a lid rotation support portion 238 are collectively disposed so as to become adjacent to one another.

In the pipe fixing portion 237, a flow path 241 is opened, and in the circumference thereof a flange 242 is disposed. The flow path 241 penetrates through inside of the refractory layer 234 and communicates with the flow path 219 of the storing portion 210. Furthermore, the pipe 220 protrudes from the flow path 219 and surrounds up to the flow path 241. As a result, an upper tip end of the pipe 220 reaches a position that is substantially level with the flange 242 of the pipe fixing portion 237.

The flange 242 and a flange 401 provided to the pipe 400 are connected at a plurality of positions with bolts (not shown in the drawing) and thereby the pipe 400 is fixed to the container main body 200. At this position, a mechanism of rotating the pipe 400 may be provided so that the pipe 400 may be rotated against the surface of which the flange 242 and the flange 401 face with each other.

The lid rotation support portion 238 is a supporting portion that pivotably and rotatably supports the small lid 300 as a first lid. Furthermore, the lid rotation support portion 238 supports the small lid 300 so that the small lid 300 is liftable from the surface of the large lid 230, for example, by substantially 2 degrees. In other words, the small lid 300 can be tilted by substantially 2 degrees upward with the lid rotation support portion 238 as a fulcrum.

(Detail Description of Small Lid 300 as the First Lid)

The small lid 300, when seen two-dimensionally, has a shape obtained by slightly expanding the opening portion 231, can cover the opening portion 231 and is disposed rotatably in horizontal direction against the opening portion 231.

The small lid 300 is provided with a cap-like metal frame main body 301 and a refractory layer 302 that buries the inside of the frame main body 301.

At an external periphery of the small lid 300, a flange 303 is disposed. The flange 303 is placed on the flange 240 disposed at an external periphery of the opening portion 231 of the large lid 230, and the flange 303 and the flange 240 can be fixed at a plurality of positions with fixing handles 304 and 305.

The fixing handle 304 is disposed, for example, at four places in the vicinity of an external periphery of the large lid 230. The fixing handles 304 each have, as shown in FIG. 4 and FIG. 5, a protrusion portion 306 protruding in a horizontal direction from the flange 303 of the small lid 300, a supporting member 307 that is pivotably held to be capable of rotating in vertical direction at an external periphery of the large lid 230, and a bolt 308 with a handle disposed to an upper end of the supporting member 307.

The bolt 308 with a handle has an inverse-L shape and thereby can be rotated easily. When the small lid 300 is fixed to the large lid 230, the supporting member 307 is rotated so that a lower tip end of the bolt 308 with a handle may be located above the protruding portion 306, and the bolt 308 with a handle is rotated so that the lower tip end thereof may be applied with a protruding portion 306 and fastened further. Thereby, the small lid 300 is fixed to the large lid 230. On the other hand, when the small lid 300 is rotated to open the opening portion 231, the bolt 308 with a handle is rotated so that the lower tip end thereof may be loosened and further separated from the protruding portion 306, then rotating the supporting member 307 so as to locate the bolt 308 with a handle lower than the small lid 300. Thereby, the bolt 308 with a handle is inhibited from interfering with the rotation of the small lid 300.

The fixing handle 305 is disposed at one place in the vicinity of a center of the large lid 230 for example. The fixing handle 305 is formed bolt-like at the lower tip end thereof, a screw hole (not shown in the drawing) wherein a bolt is threaded in is disposed at a position corresponding to the large lid 230, and when a bolt-like portion of the fixing handle 305 is bolted in the hole the small lid 300 can be fixed to the large lid 230.

At two places of the external periphery of the small lid 300, a small lid supporting and running portion 310 is disposed. The small lid supporting and running portion 310, as shown in FIG. 6, has a roller supporting portion 312 that rotatably supports the roller 311 and an lifting and lowering movement supporting portion 313 that liftably and rotatably supports the roller supporting portion 312.

The lifting and lowering movement supporting portion 313 has a guide member 314 that guides ascending and descending movement of the roller supporting portion 312 and a bolt 315 with a handle that have the roller supporting portion 312 moves up and down. In the guide member 314, a passage formed in an inverse concave shape and having a screw cutting at an upper portion thereof is disposed, the bolt with a handle 315 is screwed in the passage, and at the lower tip end of the bolt 315 with handle the roller supporting portion 312 is attached. The roller supporting portion 312 is as well formed in an inverse concave shape and in a gap thereof a roller 311 is rotatably supported.

At least one of the small lid supporting and running portions 310 is preferably disposed at a position where when the small lid 300 is rotated, a trajectory of an external periphery of the small lid 300 comes to the outermost position. This is because the small lid 300 can be lifted with the smallest force and it is as well preferable from a viewpoint of a weight balance.

In a state where the small lid 300 covers the large lid 230 and is not fastened to the large lid 230 with the fixing handles 304 and 305, when the bolt 315 with handle is rotated to lower the roller supporting portion 312, the small lid 300 is tilted upward, with a center of rotation thereof as a center, by maximum substantially 2 degrees from the large lid 230 and thereby separated from the large lid 230. In this state, when the small lid 300 is rotated in a horizontal direction, the roller 311 runs over a surface of the large lid 230. Thereby, the small lid 300 can be rotated in a horizontal direction with a smaller force. Furthermore, in a state where the small lid 300 is away from the large lid 230, when the small lid 300 covers the large lid 230, an operation reverse to that when the small lid 300 covers the large lid 230 may be carried out.

The small lid 300 is rotatably supported through a connecting plate 320 by the lid rotation support portion 238. That is, the small lid 300, with the lid rotation support portion 238 as a center of rotation, can rotate in a horizontal direction.

At the periphery of the lid rotation support portion 238, a cam follower 321 is disposed. The cam follower 321 has, as shown in FIG. 7, a guiding rail 322 that is fixed to the large lid 230 so as to circumscribe an external periphery of the lid rotation support portion 238 and has a horse-shoe shaped section opened inward, and a roller 323 that comes into contact with an upper portion of an inner periphery of the guiding rail 322. The roller 323 is rotatably attached at for example two places downward of a connecting member 238 and opposite through the lid rotation support portion 238 to the small lid 300. As mentioned above, when the small lid 300 is rotated in a horizontal direction, the roller 311 runs over a surface of the large lid 230. However, the roller 311, when rotated more than necessary, comes out of a surface of the large lid 230. At that time, the cam follower 321 compensates this. That is, when the roller 311 comes outside of a surface of the large lid 230, the roller 323 contacts with the guiding rail 322 and thereby the small lid 300 maintains a balance like a lever with the lid rotation support portion 238 as a center of support. Thereby, the small lid 300 can be rotated in a horizontal direction with a smaller force.

A gas flow path 330 for internal pressure adjustment for reducing and applying the pressure in the container main body 200 is provided at a center or a position slightly off from the center of the small lid 330. To the gas flow path 330, a pipe 331 for adding and reducing pressure is connected. The pipe 331 extends upward from the gas flow path 330, bends at a predetermined height, and extends in the horizontal direction. At a predetermined position of a vertical portion of the pipe 331, a universal joint portion 332 is inserted and a tip end in a horizontal direction of the pipe 331 is formed rotatable in a desired horizontal direction and up and down direction.

To a tip end portion in a horizontal direction of the pipe 331, a pipe (not shown) for applying pressure or for reducing pressure can be connected. A tank storing a compressed gas and a pump for applying the pressure are connected to the pipe for applying the pressure, and a pump for reducing the pressure is connected to the pipe for reducing the pressure. Then, by making use of pressure difference caused by reduction of pressure, the molten aluminum can be introduced through the pipe 400 into the container main body 200, and by making use of pressure difference caused by application of the pressure, the molten aluminum can be discharged to the outside of the container main body 200 through the pipe 400.

In the small lid 300, two passages 333 for level sensors are disposed with a predetermined distance therebetween into which two electrodes are inserted respectively as the level sensors. Each of the passages 333 is capable of being inserted with an electrode.

(Detail Description of Pipe 400)

The flange 401 of the pipe 400 is connected with a flange 242 at a plurality of positions with bolts (not shown in the drawing) and thereby the pipe 400 is fixed to the container main body 200.

In the pipe 400, an R-shaped first portion 402, a second portion 403 slightly tilted upward and outward and a third portion 404 dropping substantially vertically, respectively, are connected in this order by fastening with bolts the respective flanges. At a lower tip end of the third portion 404, an opening portion 405 (discharge port and introducing port of the molten aluminum) of the flow path is disposed.

(How to Use Container 100)

(1) Preheating of Inside of the Container 100

With the small lid 300 kept away from the opening portion 231 of the large lid 230, the inside of the storing space 215 is preheated with a gas burner.

When preheating is applied, the molten aluminum can be prevented from clogging the flow path 219.

(2) Introduction of Molten Aluminum into the Container 100

The small lid 300 is rotated in a horizontal direction to cover the opening portion 231 of the large lid 230 with the small lid 300, followed by fastening the small lid 300 to the large lid 230 with fixing handles 304 and 305.

In this state, an open end 405 of the pipe 400 is dipped in a furnace storing the molten aluminum.

A pipe for reducing pressure is attached to a tip end portion in a horizontal direction of the pipe 331 to reduce pressure from inside of the container 100.

Then, the molten aluminum stored in the furnace is introduced through the pipe 400 and the flow path 219 in the storing space 215.

(3) Removal of Oxide from Molten Aluminum in Container 100

The fixing handles 304 and 305 are loosened and the bolts 315 with handle are rotated to separate the small lid 300 from the large lid 230 by substantially 2 degrees. Then, the small lid 300 is rotated in a horizontal direction and thereby the small lid 300 is brought away of the opening portion 231 of the large lid 230.

In this state, the oxide on a surface of the molten aluminum in the storing space 215 is ladled with a tool like cup with a bar.

(4) Transportation to Use Point of Container 100

The small lid 300 is rotated in a horizontal direction to cover the opening portion 231 of the large lid 230 with the small lid 300, followed by fastening the small lid 300 to the large lid 230 with fixing handles 304 and 305.

Then, forks of a forklift are inserted in the channel members 217, and the forklift transports to a server of the molten aluminum of a desired use point. Alternatively, the container is once placed on a truck by use of the forklift and conveyed through for example a public road to a predetermined factory. There, once again, a forklift is used to convey the container to a server of the molten aluminum, which is a desired use point.

(5) Introduction of Molten Aluminum into the Container 100

A pipe for applying pressure is attached to a tip end portion in a horizontal direction of the pipe 331 to apply pressure to inside of the container 100.

Then, the molten aluminum stored in the storing space 215 is supplied through the flow path 219 and the pipe 400 to the server.

(Others)

The invention is not restricted to the above-mentioned embodiments.

For example, a shape of the container 100 may be not only a cylindrical shape but also may be a shape where a portion of the flow path 219 is protrudes toward an external periphery.

Other than the above, the invention can be variously modified and carried out within a range of the technological idea thereof.

EXPLANATION OF CODES

Figure 1:
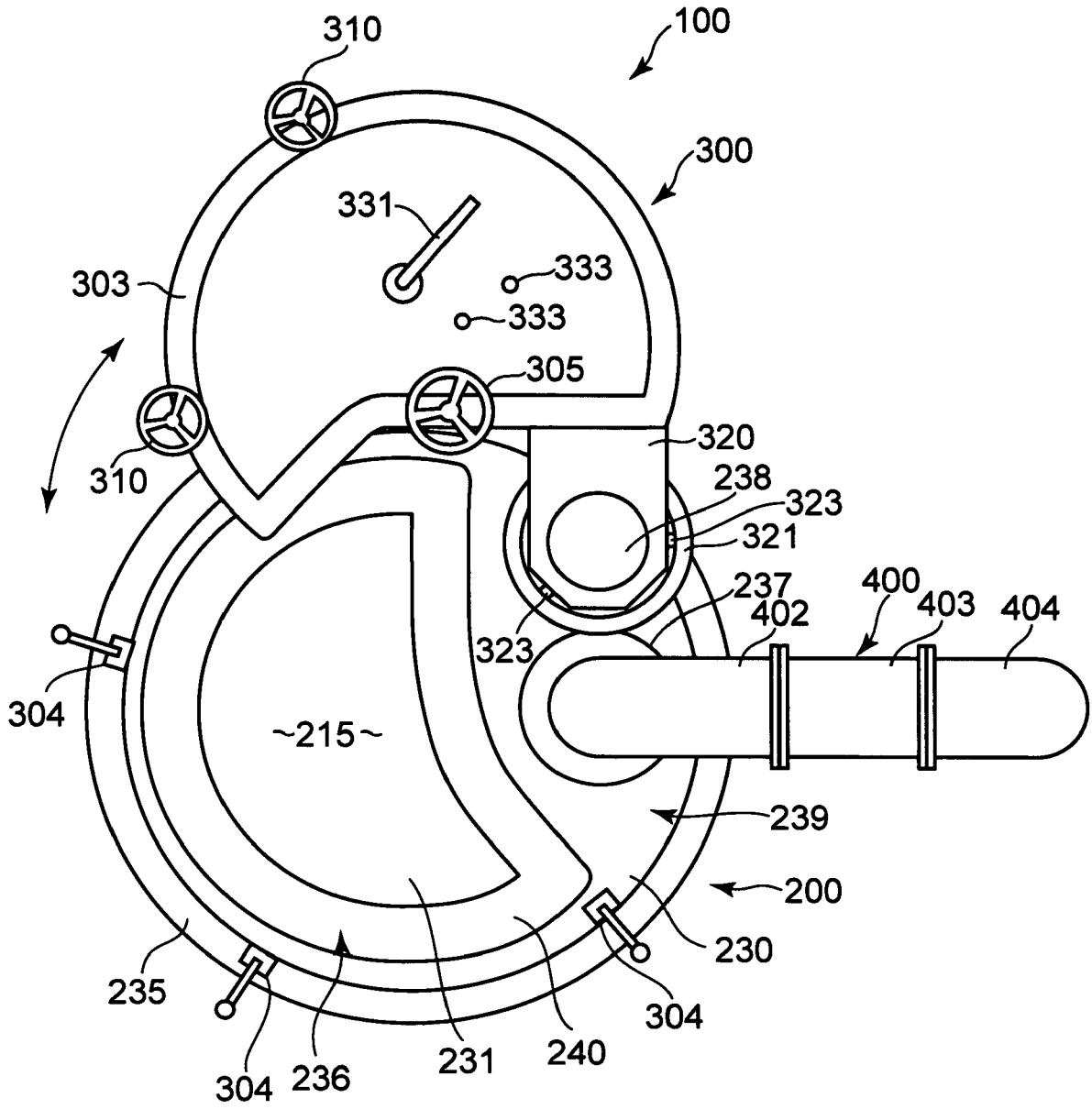
FIG. 1 is a plan view (with a first lid opened) of a container involving an embodiment of the invention.
Figure 2:
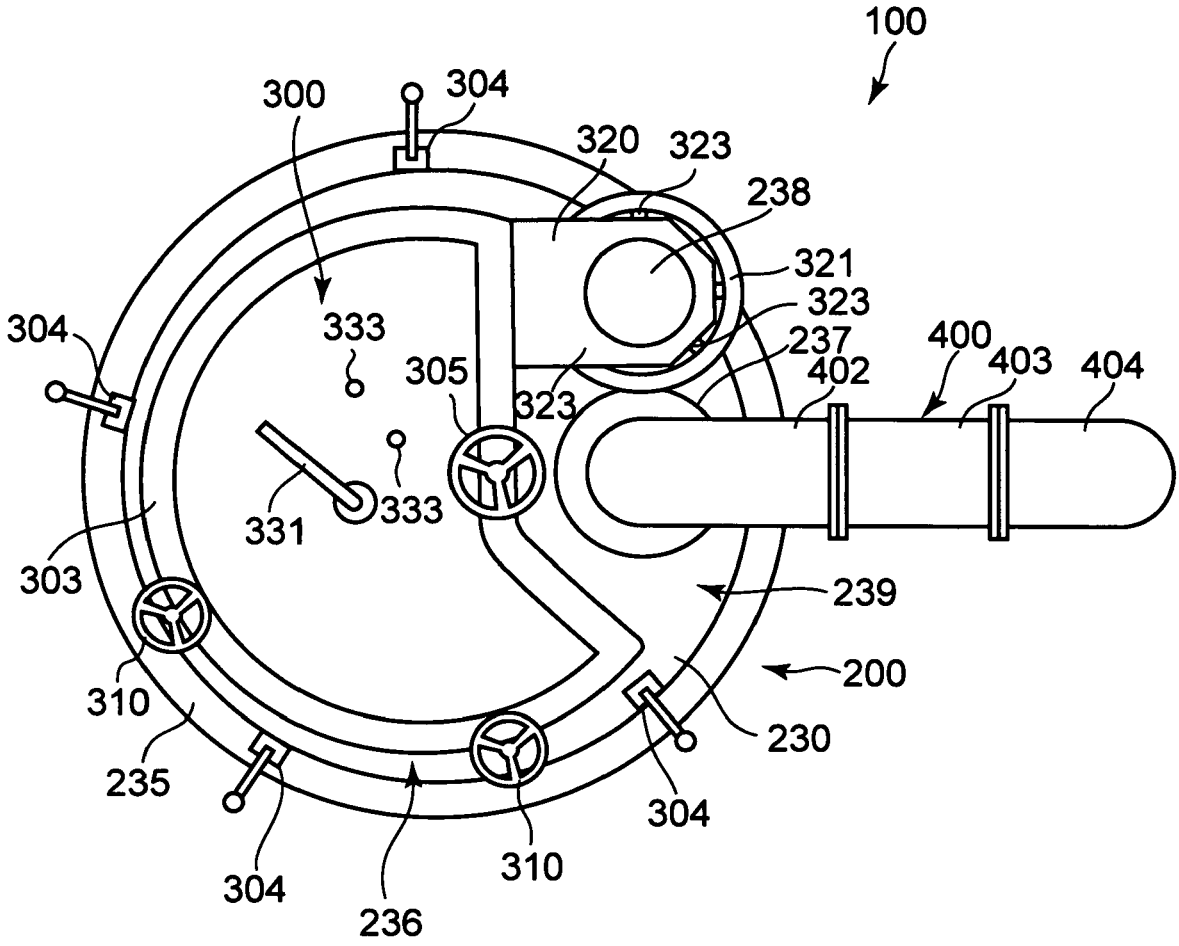
FIG. 2 is a plan view of a container when a first lid of FIG. 1 is closed.
Figure 3:
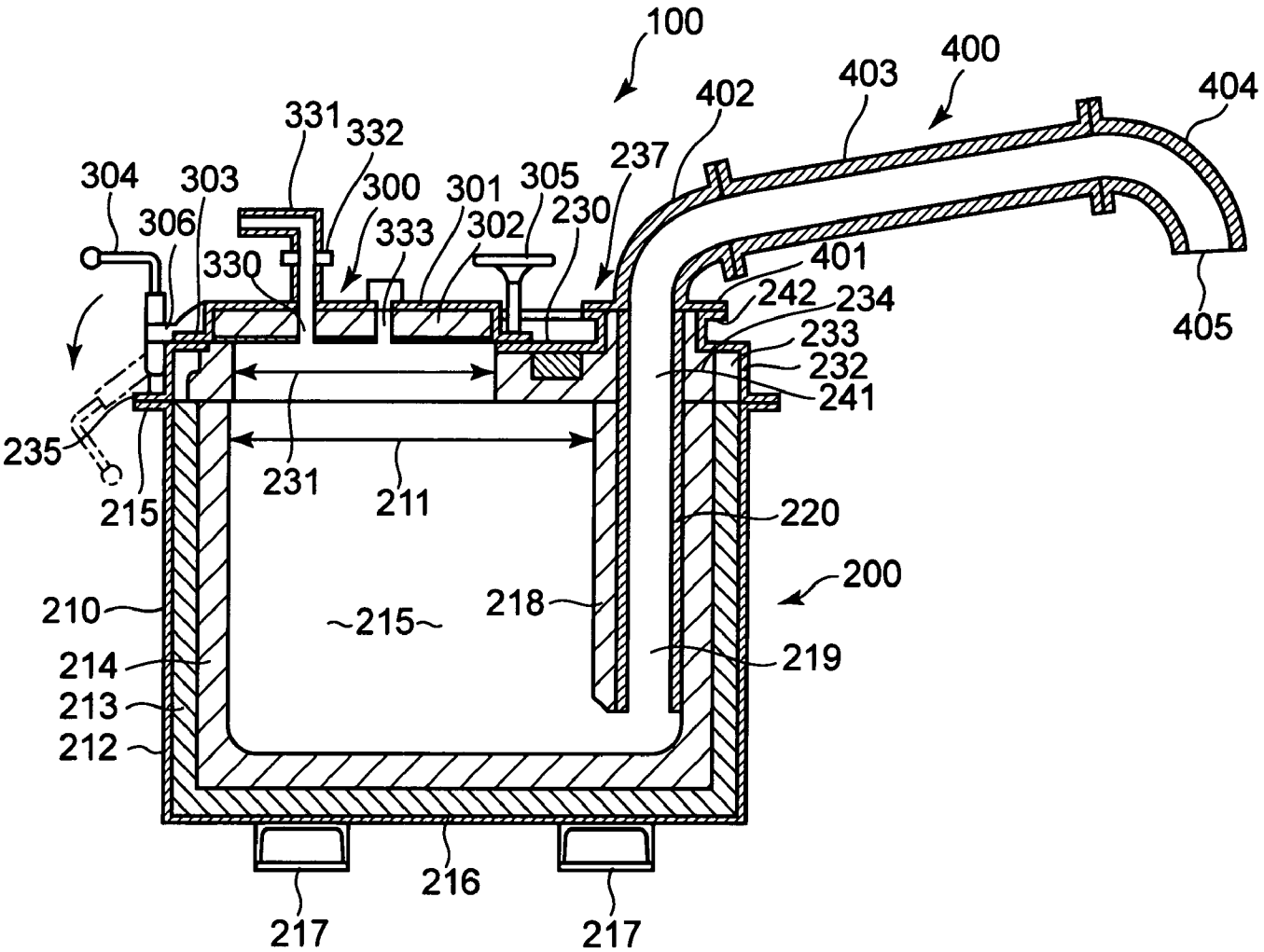
FIG. 3 is a vertical sectional view of FIG. 2.
Figure 4:
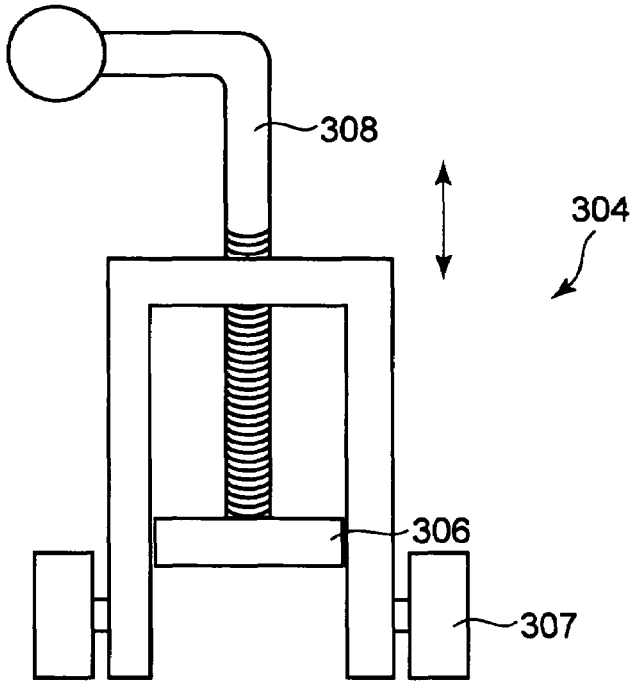
FIG. 4 is an enlarged front view of a fixing handle.
Figure 5:
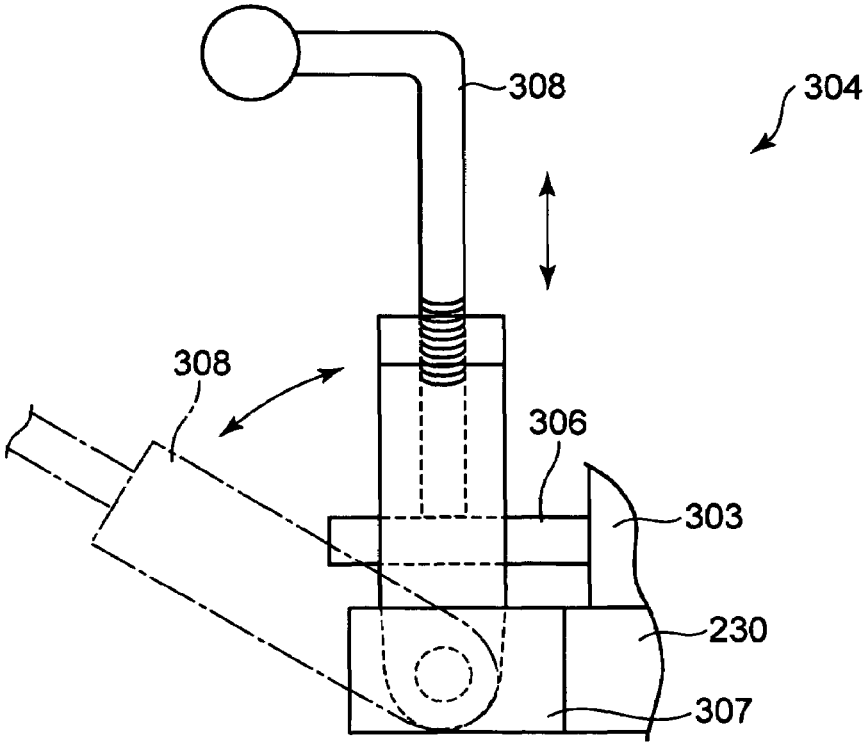
FIG. 5 is an enlarged side view of a fixing handle.
Figure 6:
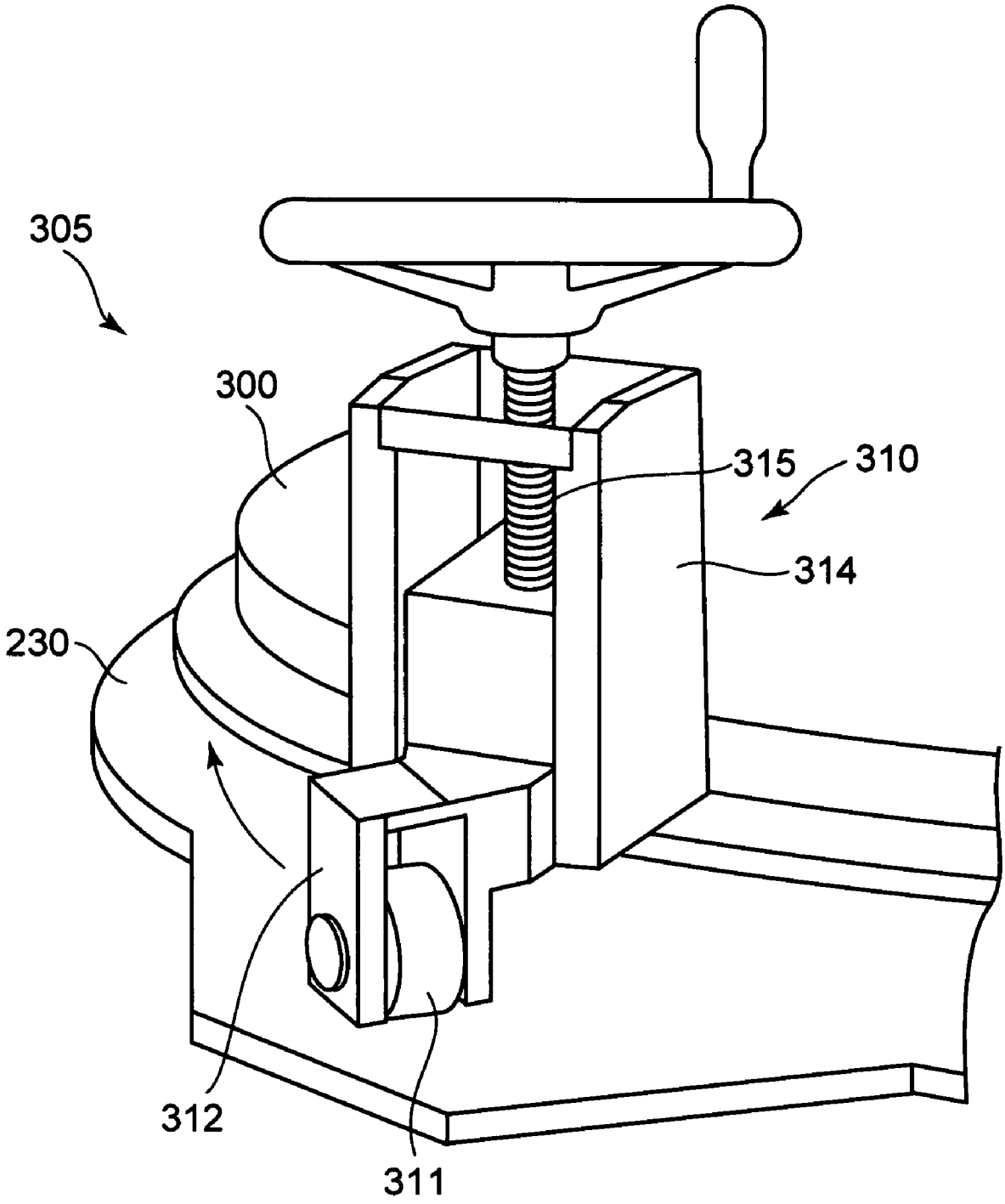
FIG. 6 is an enlarged view of a small lid supporting and running portion.
Figure 7:
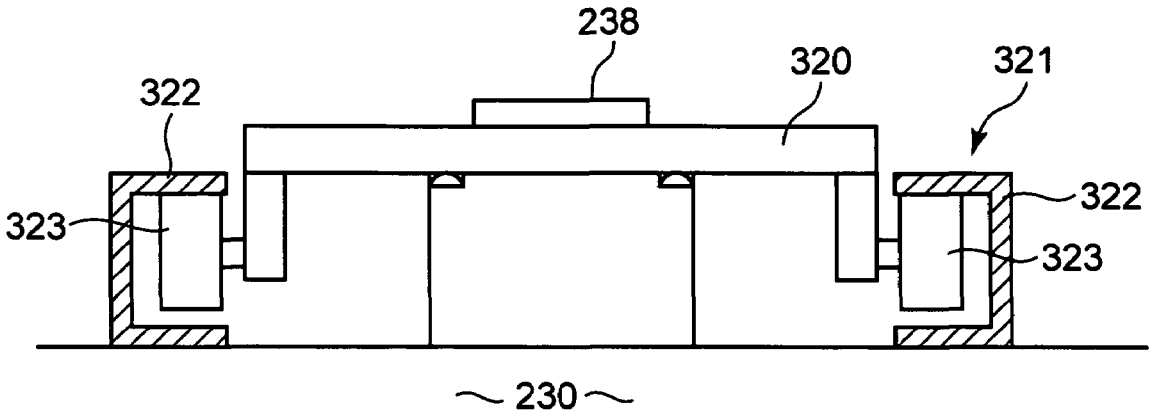
FIG. 7 is an explanatory diagram of a cam follower.

100 Container
200 Container main body
210 Storing portion
211 Opening portion
215 Storing space
218 Protruding portion
219 Flow path
230 Large lid
231 Opening portion
236 First area
237 Pipe fixing portion
238 Lid rotation support portion
239 Second area
241 Flow path
300 Small lid as a first lid
304, 305 Fixing handle
310 Small lid supporting and running portion
313 Lifting and lowering movement supporting portion
321 Cam follower
400 Pipe

What is claimed is:

1. A container, comprising:

a container main body, having a first opening in an upper portion thereof, capable of storing a molten metal;

a first lid capable of covering the first opening and rotating in a horizontal direction against the first opening;

a pressurized gas introducing port that introduces a gas for applying pressure into the container main body; and a flow path that supplies the molten metal stored inside the container main body to an outside, wherein the container main body has a storing portion having a second opening that is larger than the first opening in an upper portion thereof, and a second lid fixed to the storing portion to cover the second opening, having the first opening, wherein the second lid has a supporting portion that rotatably and pivotably supports the first lid, wherein the first lid is supported by the supporting portion to be capable of being lifted up from a surface of the second lid, and wherein the container further comprises a first supporting and guiding member, having a first roller rotatably contacts to an area other than the first opening on the surface of the second lid and capable of moving up and down, and the first supporting and guiding member is disposed on an outer peripheral of the first lid.

2. The container as set forth in claim 1, further comprising:

a second roller disposed near the supporting portion of the first lid; and a second supporting and guiding member having a guiding rail disposed on the container main body that supports and guides the second roller when the first roller is at a position away from the surface of the second lid.

3. A container, comprising:

a container main body, capable of storing a molten metal inside thereof, having a first area and a second area in an upper portion thereof: the first area is provided with a first opening and the second area is provided with a pipe fixing portion and a lid rotation support portion;

a first lid capable of covering the first opening and disposed at the lid rotation support portion so that the first lid rotates in a horizontal direction against the first opening;

a flow path that supplies the molten metal stored inside the container main body to an outside;

a pipe, disposed at the pipe fixing portion, communicating with the flow path; and a pressurized gas introducing means that introduces a gas for applying pressure into the container main body, wherein the first lid is supported by the supporting portion to be capable of being lifted up from a surface of the second lid, and wherein the container further comprises a first supporting and guiding member, having a first roller rotatably contacts to an area other than the first opening on the surface of the second lid and capable of moving up and down, and the first supporting and guiding member is disposed on an outer peripheral of the first lid.

4. The container as set forth in claim 3, wherein the first lid has:

a lid main body capable of covering the first opening, and a connecting member rotatably disposed at the lid rotation support portion and supporting the lid main body.

* * * * *